US009896797B2

(12) United States Patent
Shin et al.

(10) Patent No.: US 9,896,797 B2
(45) Date of Patent: Feb. 20, 2018

(54) DRYER FOR CLOTHES

(71) Applicant: LG ELECTRONICS INC., Seoul (KR)

(72) Inventors: Jinhyouk Shin, Seoul (KR); Woocheol Kang, Seoul (KR); Minseong Kim, Seoul (KR); Sungjun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/304,340

(22) PCT Filed: Apr. 14, 2015

(86) PCT No.: PCT/KR2015/003731
§ 371 (c)(1),
(2) Date: Oct. 14, 2016

(87) PCT Pub. No.: WO2015/160172
PCT Pub. Date: Oct. 22, 2015

(65) Prior Publication Data

US 2017/0037560 A1 Feb. 9, 2017

(30) Foreign Application Priority Data

Apr. 17, 2014 (KR) ..... 10-2014-0045717

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/02; D06F 58/22; D06F 58/28; D06F 2058/2829
(Continued)

(56) References Cited

U.S. PATENT DOCUMENTS 3,748,746 A * 7/1973 Robandt ..... D06F 58/22 34/82
4,033,047 A * 7/1977 Kawai ..... D06F 58/02 34/605
(Continued)

FOREIGN PATENT DOCUMENTS

EP 1380683 A2 * 1/2004 ..... D06F 58/22
EP 1598474 A1 * 11/2005 ..... D06F 58/02
(Continued)

OTHER PUBLICATIONS

International Search Report and Written Opinion dated Jul. 3, 2015 issued in Application No. PCT/KR2015/003731 (full English text).
(Continued)

*Primary Examiner* — Stephen M Gravini
(74) *Attorney, Agent, or Firm* — KED & Associates, LLP

(57) ABSTRACT

Provided is a dryer for clothes. The dryer for the clothes includes a lint filter assembly, and a lint filter cleaning device for removing lint attached to the lint filter assembly. The lint filter assembly includes a filter frame defining an edge thereof, a mesh member attached to the filter frame to cover an inner region of the filter frame, and a partition rib including a plurality of horizontal ribs and vertical ribs which are disposed inside the filter frame. The mesh member is partitioned into a plurality of filtering blocks by the plurality of horizontal ribs and vertical ribs.

16 Claims, 6 Drawing Sheets

(58) Field of Classification Search
USPC ..... 34/82, 595–610; 68/19, 20
See application file for complete search history.

(56) References Cited

U.S. PATENT DOCUMENTS

| | | | | | |
|---|---|---|---|---|---|
| 4,653,200 | A * | 3/1987 | Werner | D06F 58/22 | 34/604 |
| 5,062,219 | A * | 11/1991 | Harris | D06F 58/02 | 34/242 |
| 5,706,588 | A * | 1/1998 | Dausch | D06F 58/22 | 34/327 |
| 7,559,156 | B2 * | 7/2009 | Renzo | D06F 58/04 | 34/595 |
| 7,644,515 | B2 * | 1/2010 | Doh | D06F 58/22 | 34/603 |
| 7,895,771 | B2 * | 3/2011 | Prajescu | D06F 58/04 | 138/114 |
| 8,381,412 | B2 * | 2/2013 | Ahn | D06F 58/20 | 34/480 |
| 8,468,711 | B2 * | 6/2013 | Kim | D06F 58/22 | 134/12 |
| 8,615,895 | B2 | 12/2013 | Shin et al. | | |
| 8,800,165 | B2 * | 8/2014 | Kwon | D06F 25/00 | 134/18 |
| 9,027,256 | B2 * | 5/2015 | Kim | F26B 21/003 | 34/86 |
| 9,163,351 | B2 * | 10/2015 | Kim | D06F 25/00 | |
| 9,194,073 | B2 * | 11/2015 | Kwon | D06F 25/00 | |
| 9,657,431 | B2 * | 5/2017 | Kim | D06F 58/22 | |
| 2008/0235978 | A1 * | 10/2008 | Epstein | D06F 58/22 | 34/82 |
| 2017/0037560 | A1 * | 2/2017 | Shin | D06F 58/02 | |

FOREIGN PATENT DOCUMENTS

| | | | | |
|---|---|---|---|---|
| EP | 2 386 679 | | 11/2011 | |
| EP | 2 559 805 | | 2/2013 | |
| KR | 10-2007-0076853 | | 7/2007 | |
| KR | 10-0762332 | | 10/2007 | |
| KR | 10-2011-0125570 | | 11/2011 | |
| KR | 10-1186159 | | 10/2012 | |
| KR | 10-1349844 | | 1/2014 | |
| WO | WO 2016006900 | A1 * | 1/2016 | D06F 58/20 |

OTHER PUBLICATIONS

Chinese Office Action dated Jun. 2, 2017 issued in Application No. 201580015524.0 (English translation attached).

* cited by examiner

[Fig. 1]
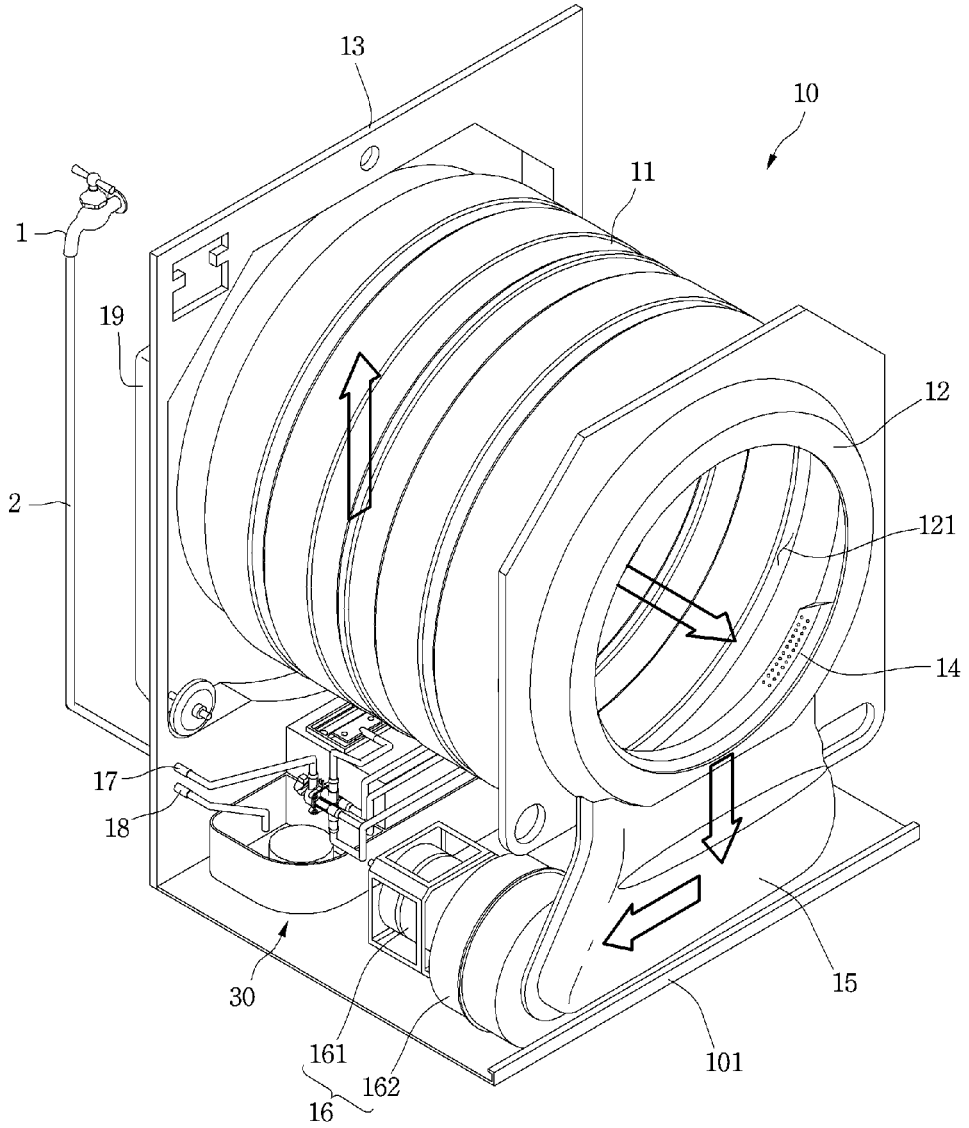

[Fig. 2]
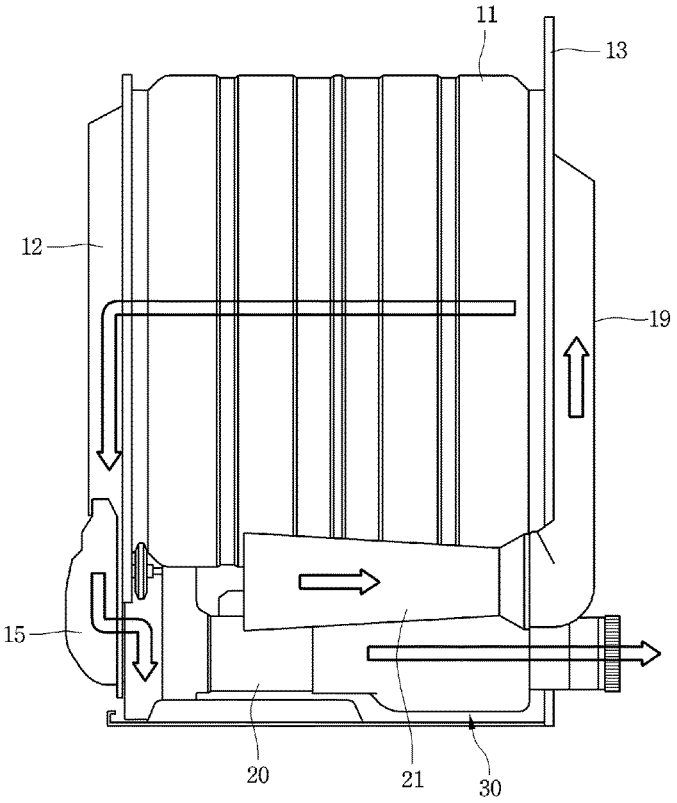
[Fig. 3]
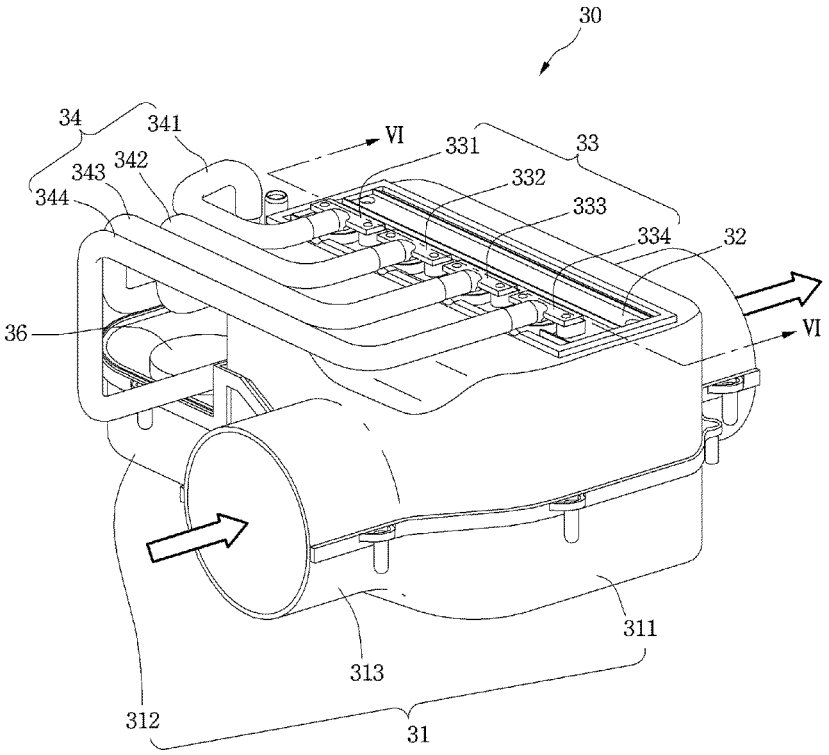

[Fig. 4]
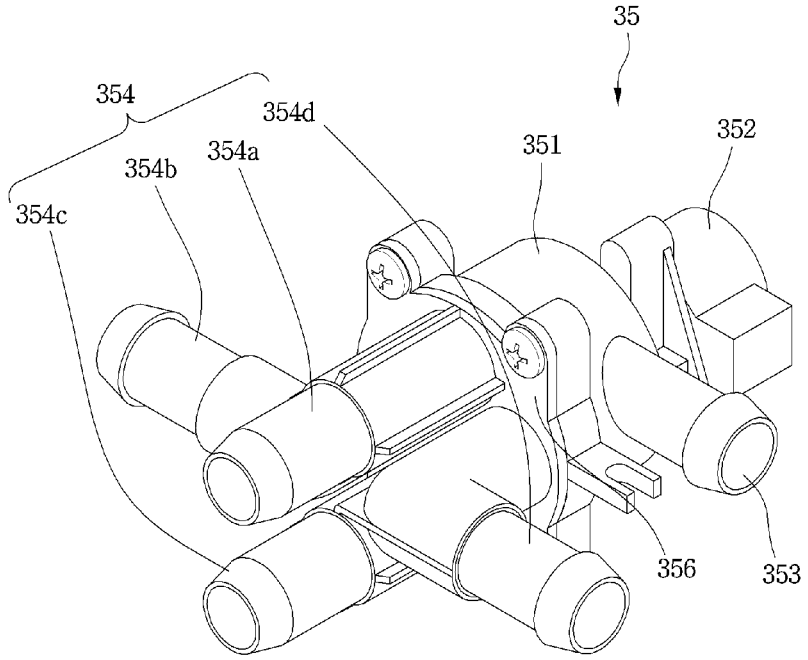
[Fig. 5]
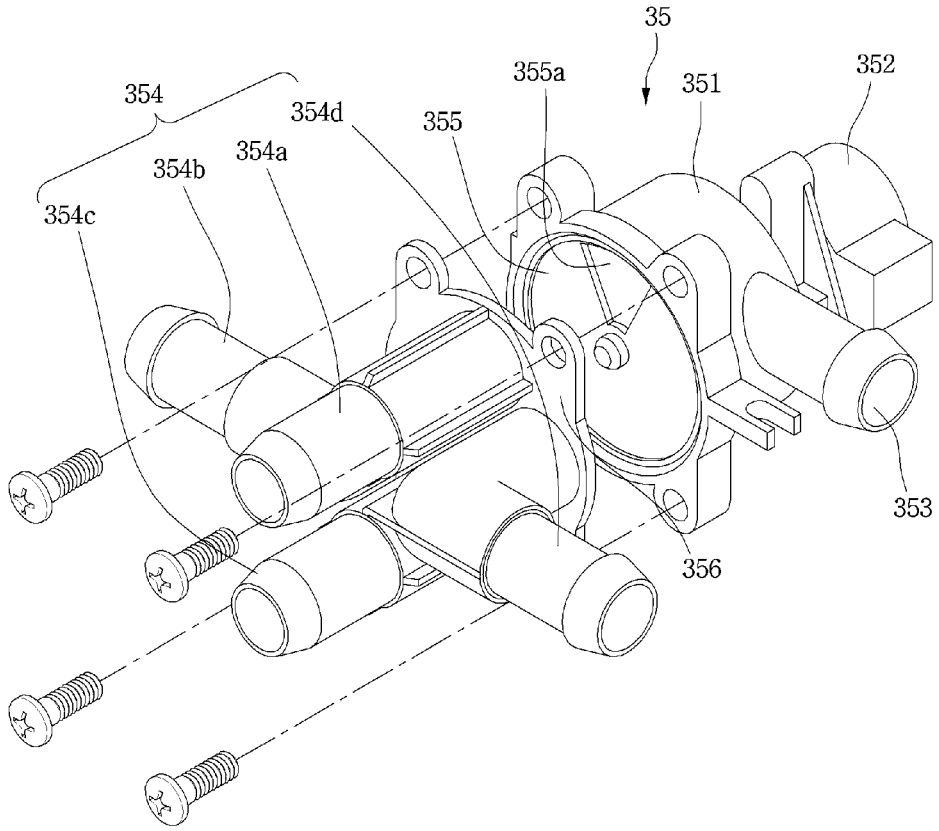

[Fig. 6]
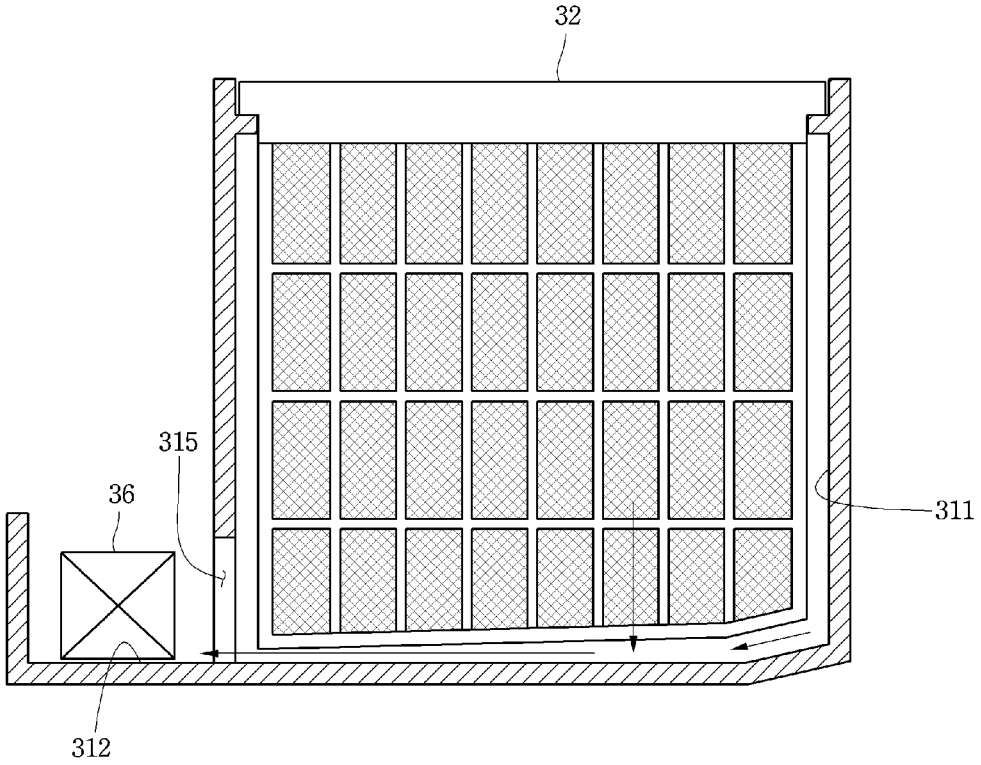
[Fig. 7]
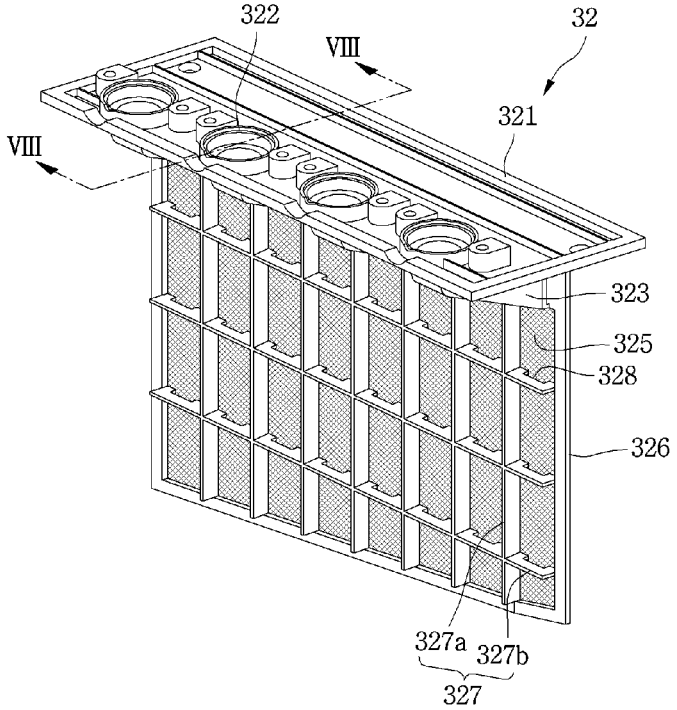

[Fig. 8]
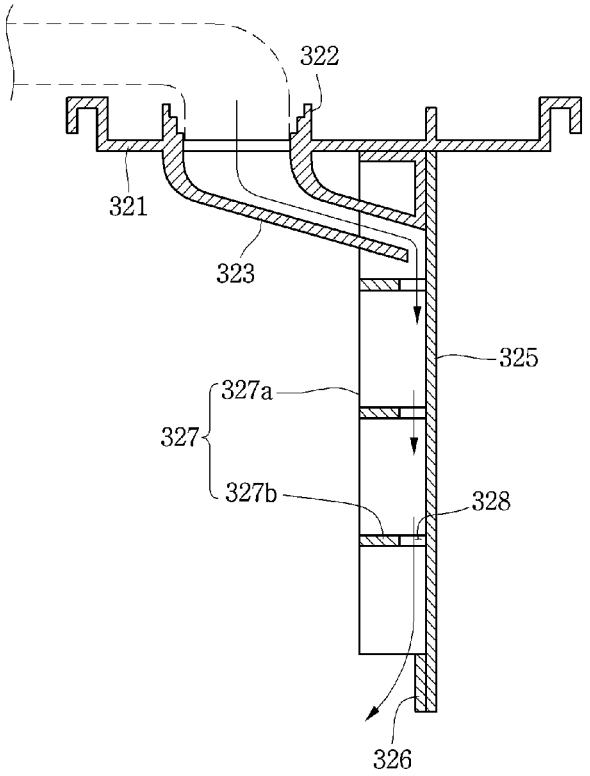
[Fig. 9]
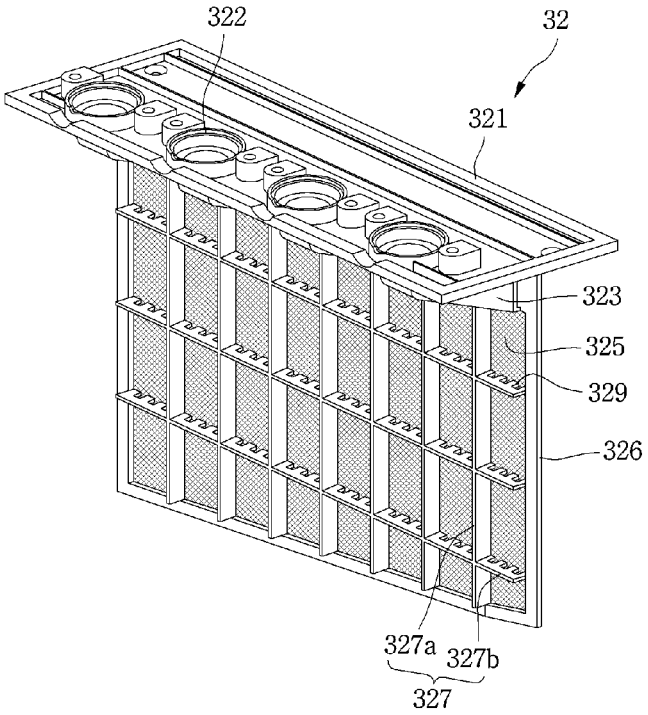

[Fig. 10]
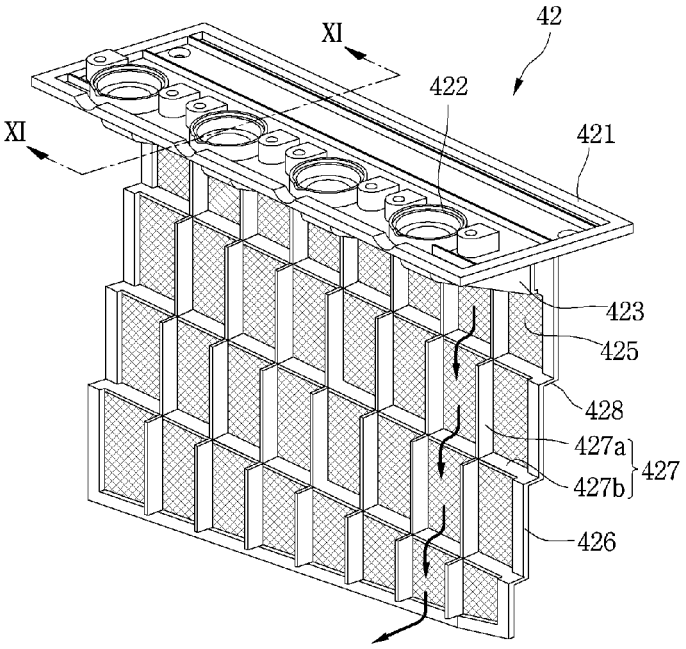
[Fig. 11]
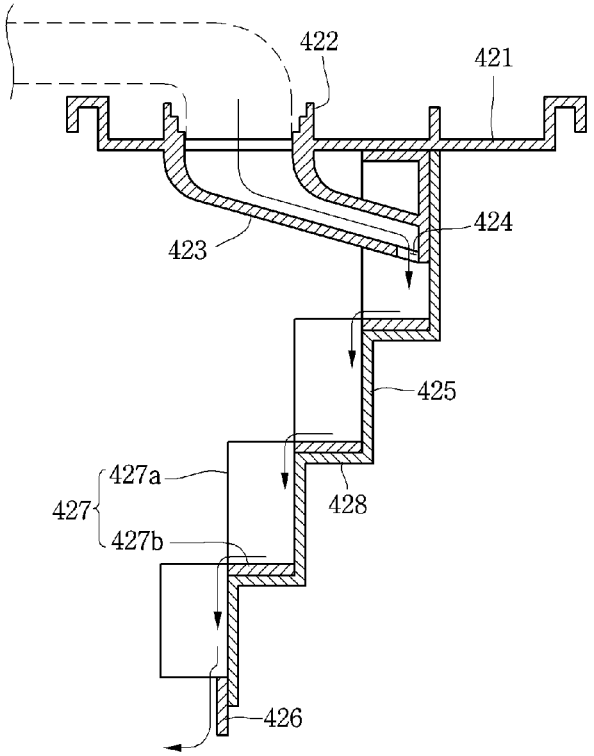

DRYER FOR CLOTHES

CROSS-REFERENCE TO RELATED PATENT APPLICATIONS

This application is a U.S. National Stage Application under 35 U.S.C. § 371 of PCT Application No. PCT/KR2015/003731, filed Apr. 14, 2015, which claims priority to Korean Patent Application No. 10-10-2014-0045717, filed Apr. 17, 2014, whose entire disclosures are hereby incorporated by reference.

TECHNICAL FIELD

The present disclosure relates to a dryer for clothes.

BACKGROUND ART

Dryers for clothes are home appliances that supply hot air into a drying drum to remove moisture absorbed into clothes in a state where objects to be dried are put into the rotating drum. Hot air supplied into a drum may be generated by using electrical resistance heat or combustion heat using a gas fuel. Then, the hot air may be supplied into the drying drum by using a blower fan.

Also, dryers for clothes may be classified into forced convection dryers and air vented dryers according to a hot air supply method. That is, the forced convection dryers may be dryers in which hot air supplied into a drying drum is repeatedly heated and cooled while circulating the inside of the dryer, and the air vented dryers may be dryers in which hot air supplied into a drying drum is discharged from the drying drum to the outside.

During the drying of clothes, lint attached to clothes may be separated and thus floated in air discharged from a drying drum, and foreign substances existing in the clothes may drop onto the bottom of the during drum. To remove the lint contained in the air discharged from the drying drum, a lint filter assembly is mounted in a passage through which the air discharged from the drying drum flows.

When the lint is deposited on the lint filter assembly, the lint may interrupt a flow of air to increase a load of the blower fan. As a result, drying performance may be deteriorated, power consumption may increases, and the lint may act as a failure cause of the blower fan. Furthermore, the lint generated during the drying process may be introduced into a fan motor or combustion device that is mounted on a lower portion of the drying drum through a gap between the drying drum and a cabinet to cause fire in the dryer.

To solve this limitation, the foreign substances deposited on the lint filter assembly have to be periodically removed. In case of a detachable lint filter assembly, a user may periodically separate the lint filter assembly to clean the lint filter assembly and then mount the lint filter assembly again.

Various methods for easily removing lint deposited on the lint filter assembly are being attempted. Recently, a lint removing structure of for removing lint by using water in a state where a lint filter assembly is mounted within the dryer is being proposed. For example, a filter cleaning device of a clothes dryer is disclosed in Korean Patent Registration No. 10-1186159.

In Korean Patent Registration No. 10-1186159 according to the related art, water is sprayed through nozzles disposed at front and rear sides of the lint filter assembly to remove lint deposited on the lint filter assembly. However, the lint filter assembly mounted on the cloths dryer according to the related art may be a mash-shaped filter. Thus, the lint filter assembly may generate a lint deposition lump having a size corresponding to that of the filter. Also, when the water is sprayed through the nozzles, the lint lump separated from the lint filter assembly may have a significantly large size. The water sprayed from the nozzles and the lint lump separated from the lint filter assembly may be introduced into a drain pump and then discharged to the outside of the dryer. However, since a pumping chamber in which an impeller of the drain pump is accommodated has an inlet that has a size significantly less than that of the lint lump separated from the lint filter assembly, the lint lump may block the inlet or an outlet of the pumping chamber to increase a load of the drain pump. Also, the increase of the load of the drain pump may ultimately cause a damage of the drain pump.

DISCLOSURE OF INVENTION

Technical Problem

The present disclosure is proposed to improve the above-described limitations.

Solution to Problem

In one embodiment, a dryer for clothes includes: a cabinet; a drying drum accommodated in the cabinet and into which an object to be dried is put; a suction passage supplying hot air into the drying drum; a heating unit disposed in any position of the suction passage to heat the air introduced into the suction passage at a high temperature; an exhaust passage through the hot air discharged from the drying drum flows; a blower mounted on one position of the exhaust passage to forcibly blow the air within the drying drum; a lint filter assembly mounted on the other position of the exhaust passage; and a lint filter cleaning device for removing lint attached to the lint filter assembly, wherein the lint filter assembly includes: a filter frame defining an edge thereof; a mesh member attached to the filter frame to cover an inner region of the filter frame; and a partition rib including a plurality of horizontal ribs and vertical ribs which are disposed inside the filter frame, wherein the mesh member is partitioned into a plurality of filtering blocks by the plurality of horizontal ribs and vertical ribs.

Advantageous Effects of Invention

According to the dryer for the clothes according to the embodiment, the partition rib having the lattice structure may be disposed inside the filter frame of the lint filter assembly to divide and collect the lint generated during the drying onto the lint filter assembly. Thus, the lint lump separated from the lint filter assembly while the lint filter assembly is cleaned may be minimized in size.

Also, the limitation in which the lint separated from the lint filter assembly blocks the inlet and outlet of the drain pump to deteriorate the drying performance may be improved.

Also, in the dryer of the clothes according to the embodiment, the lint filter assembly is partitioned into the plurality of filtering blocks, and a difference between the filter cleaning times for the blocks may be generated. Thus, since the lint lumps each of which has a small size are introduced to the drain pump with a time difference, the phenomenon in which the inlet and outlet of the pumping chamber of the drain pump are blocked by the lint lumps may be minimized.

BRIEF DESCRIPTION OF DRAWINGS

FIG. 1 is a perspective view of a dryer for clothes including a lint filter cleaning device according to an embodiment.

FIG. 2 is a side view of the dryer for the clothes.

FIG. 3 is a perspective view of the lint filter cleaning device according to an embodiment.

FIG. 4 is a perspective of a control valve provided in the lint filter cleaning device according to an embodiment.

FIG. 5 is an exploded perspective view of the control valve.

FIG. 6 is a cross-sectional view taken along line VI-VI of FIG. 3.

FIG. 7 is a perspective view illustrating an outer appearance of a lint filter assembly mounted on the lint filter cleaning device according to an embodiment.

FIG. 8 is a longitudinal cross-sectional view taken along line VIII-VIII of FIG. 7.

FIG. 9 is a perspective view illustrating an outer appearance of a lint filter assembly according to another embodiment.

FIG. 10 is a perspective view illustrating an outer appearance of a lint filter assembly according to further another embodiment.

FIG. 11 is a longitudinal cross-sectional view taken along line XI-XI of FIG. 10.

MODE FOR THE INVENTION

Hereinafter, a dryer for clothes including a lint filter cleaning device according to an embodiment will be described in detail with reference to the accompanying drawings. Also, an air vented dryer will be described as an example of the dryer for the clothes including the lint filter cleaning device according to an embodiment. However, the lint filter cleaning device according to an embodiment may be applied to various types of dryers for clothes including a forced convection dryer as well as the air vented dryer.

FIG. 1 is a perspective view of a dryer for clothes including a lint filter cleaning device according to an embodiment, and FIG. 2 is a side view of the dryer for the clothes.

Referring to FIGS. 1 and 2, a dryer for clothes (hereinafter, referred to as a "clothes dryer") including a lint filter cleaning device according to an embodiment may include a drying drum 11 into objects to be dried are put, a front cabinet 12 supporting a front part of the drying drum 111, a blocking member mounted on a bottom part of the front cabinet 12, a rear cabinet 13 supporting a rear part of the drying drum 11, and a lint filter cleaning device 30 disposed under the drying drum 11.

Also, the clothes dryer 10 may further include a suction duct 21 for suctioning air to be supplied into the drying drum 11, a rear duct 19 connecting the suction duct 21 to an air inflow hole defined in a rear surface of the drying drum 11, a guide duct 15 connected to a bottom surface of the front cabinet 12 to guide air discharged from the drying drum 11, a blower 16 connected to an outlet end of the guide duct 15, and an exhaust duct 20 connected to an outlet end of the blower 16.

The lint filter cleaning device 30 may be mounted on any position of the exhaust duct 20 to filter lint contained in air flowing along the exhaust duct 20 while the air passes through a lint filter assembly provided in the lint filter cleaning device 30.

A middle cabinet (not shown) is disposed between the front cabinet 12 and the rear cabinet 13 to protect the drying drum 11 and various components disposed under the drying drum 11. The middle cabinet may define both side surfaces and top surface of the clothes dryer 10. A base plate 101 defining a bottom part of the clothes dryer 10 may be disposed on a bottom surface of the middle cabinet, and the components may be mounted on the base plate 101.

Also, the blocking member 14 may prevent foreign substances contained in the objects to be dried, for example, bulky and hard foreign matters a coin, a ballpoint pen, and the like from being suctioned into the guide duct 15 during the drying process. The foreign substances such as the lint may be filtered by the lint filter assembly (that will be described later) mounted on the lint filter cleaning device 30 even though the foreign substances are introduced into the guide duct 15. Other foreign substances, i.e., bulky and soft foreign matters may be blocked by the blocking member 14 to remain in the drying drum 11.

If foreign substances except for the lint are suctioned into the guide duct 15, the blower 16 may be damaged, or a rattling sound may be generated inside the exhaust duct 20. Thus, it may be necessary to prevent the foreign substances from being out of the drying drum 11 through the blocking member 14. Also, the blocking member 15 may be detachably coupled to the front cabinet 12.

Also, the lint filter cleaning device 30 is connected to a cleaning water supply tube 17 and a cleaning water drain tube 18. The cleaning water supply tube 17 may have an inlet end mounted on the rear cabinet 13 and connected to a water supply tube 2 connected to an external water supply source 1. Also, the cleaning water supply tube may have an outlet end connected to an inflow port 353 of a control valve (see reference numeral 35 of FIG. 4) of the lint filter cleaning device 30. Also, the cleaning water drain tube 18 may have an inlet end connected to a drain pump (see reference numeral 36 of FIG. 3) of the lint filter cleaning device 20.

Also, the blower 16 may include a fan motor 161 and a blower fan 162 connected to a rotation shaft of the fan motor 161. The blower fan 162 is disposed on an output end of the guide duct 15 to guide the air, which passes through the drying drum 11 and guided to the guide duct 15, to the exhaust duct 20.

Also, in case of the air vented dryer, a gas combustion device is disposed on an inlet of the suction duct 21 to heat air suctioned into the suction duct 21 at a high temperature. Also, in case of an electric dryer, an electric heater is mounted inside the rear duct 19 to heat air introduced into the suction duct 21 at a high temperature before the air is introduced into the drying drum 11.

Briefly explaining the drying process of the clothes dryer 10 including the above-described constitutions, objects to be dried are put into the drying drum 11 through an input hole 121 defined in the front cabinet 12.

Also, when a drying start command is inputted, the blower 16 operates to the air introduced into the suction duct 21 at a high temperature by using the gas combustion device or electric heater.

Then, the air heated at the high temperature is introduced into the drying drum 11 through a rear surface of the drying drum 11 along the rear duct 19. The high-temperature and dry air introduced into the drying drum 11 changes into high-temperature and humidity air while drying the objects to be dried.

Also, the high-temperature and humidity air passes through the blocking member 14 in a state where the air contains lint generated from the objects to be dried and then is guided to the guide duct 15. Also, the high-temperature and humidity air guided to the guide duct 15 is guided to the exhaust duct 20 by the blower 16.

Also, the lint contained in the high-temperature and humidity air guided to the exhaust duct 20 is filtered by the lint filter assembly while passing through the lint filter cleaning device 30. Also, the lint filter cleaning device 30 operates to separate the lint attached to the lint filter assembly and then discharge the lint together with cleaning water by using the drain pump.

Hereinafter, a structure and operation of the lint filter cleaning device 30 will be described with reference to the accompanying drawings.

FIG. 3 is a perspective view of the lint filter cleaning device according to an embodiment.

Referring to FIG. 3, the lint filter cleaning device 30 according to an embodiment may include a cleaning case 31 constituted by a filter housing 311 and a pump housing 312, a lint filter assembly 32 disposed inside the filter housing 311, a water supply port array 33 disposed on a top surface of the lint filter assembly 32, a water supply tube array 34 connected to an outlet end of the water supply port array 33, a control valve 35 connected to an inlet end of the water supply tube array 34, and a drain pump accommodated within the pump housing 312.

The lint filter assembly 32 vertically stands up inside the filter housing 311. Also, an inflow hole 313 through which the high-temperature and humidity air passing through the drying drum 11 is introduced is defined in one side of the filter housing 311, and a discharge hole 314 through which the high-temperature and humidity air passing through the lint filter assembly 32 is discharged is defined in a surface opposite to the surface in w which the inflow hole 313 is defined. Also, the pump housing 312 and the filter housing 311 communicate with each other through a communication hole (see reference numeral 315 of FIG. 6).

Also, the water supply port 33 may include a plurality of ports that are disposed to be spaced a predetermined distance from each other on a top surface of the lint filter assembly 32. Although the water supply port array 33 includes first to fourth supply ports 331, 332, 333, and 334 in the current embodiment, the present disclosure is not limited thereto. For example, the number of supply ports may be adequately set according to a size of the lint filter assembly 32.

Also, the water supply tube array 34 may include a plurality of supply tubes connected to the water supply port array 33. Although the water supply array 34 includes first to fourth water supply tubes 341, 342, 343, and 344 in the current embodiment, the present disclosure is not limited thereto. For example, the number of water supply tubes may be adequately set according to the number of supply ports.

Also, a hole into which the lint filter assembly 32 is inserted is defined in a top surface of the filter housing 311.

FIG. 4 is a perspective of the control valve provided in the lint filter cleaning device according to an embodiment, and FIG. 5 is an exploded perspective view of the control valve.

Referring to FIGS. 4 and 5, the control valve 35 provided in the lint filter cleaning device 30 according to an embodiment may include a valve case 351 having a changer into which water supplied from the external water supply source 1 is collected, a control disk 355 having a disk shape and rotatably disposed inside the valve case 351, a valve motor 352 of which a rotation shaft is connected to a center of the control disk 355 to rotate the control disk 355, a valve cover coupled to a front side of the valve case 351 to cover a front opening of the valve case 351, and an inflow port 353 connected to one side surface of the valve case 351, and a discharge port array 354 disposed on the valve cover 356. Also, one or a plurality of communication holes 355*a* may be defined on one side of the control disk 355.

In detail, the discharge port array 354 may include first to fourth discharge ports 354*a*, 354*b*, 354*c*, and 354*c*. The number of discharge ports may correspond to that of water supply ports. Also, inlet ends of the discharge ports may be disposed to be spaced a predetermined distance from each other in a circumferential direction of the valve cover 356.

As the control disk 355 rotates at a predetermined angle, the communication hole 355*a* may be disposed at one inlet end of the plurality of discharge ports to open the discharge port facing the communication hole 355*a*.

When one communication hole 355*a* is provided, only one discharge port of the plurality of discharge ports may be opened. As the control disk 355 rotates, the plurality of discharge ports may be successively opened.

Also, the discharge port to be opened may be determined by a rotation angle of the control disk 355. In addition, an opening rate of the discharge port may be determined according to the rotation rate of the control disk 355.

When the communication hole 355*a* is provided in plurality, the plurality of discharge ports may be opened at the same time. Also, the discharge ports to be opened at the same time may be determined by the distance between the plurality of communication holes 355*a* in the circumferential direction within the control disk 355. Also, the discharge ports to be opened at the same time may be determined by the rotation angle of the control disk 355, and an opening rate of the discharge ports may be determined by the rotation rate of the discharge ports.

Inlet ends of the first to fourth water supply tubes 341 to 344 are connected to the first to fourth discharge ports 345*a* to 345*d*, respectively. The cleaning water supplied into the valve case 351 through the inflow port 353 may be supplied into the water supply port array 33 along the water supply tube array 34.

The water supplied into the water supply port array 33 may flow downward along the lint filter assembly 32 to separate the lint lump attached to the lint filter assembly 32 from the lint filter assembly 32.

FIG. 6 is a cross-sectional view taken along line VI-VI of FIG. 3.

Referring to FIG. 6, the pump housing 312 and the filter housing 311 of the lint filter cleaning device 30 according to an embodiment are fluidly connected to each other through the communication hole 315 as described above.

In detail, the pump housing 312 is disposed outside the filter housing 311. The communication hole 315 is defined in one position of a bottom part of a wall that defines the filter housing 311 and partitions the pump housing 312 from the filter housing 311.

Also, the bottom part of the filter housing 311 may be inclined upward in a direction that is away from the communication hole 315. Thus, the cleaning water supplied from the water supply port array 33 to flow down along the filter assembly 31 and the lint lump may flow toward the communication hole 315 and then be concentrated into the pump housing 312. Also, the drain pump 36 may operate to discharge the lint lump and the cleaning water to the outside of the dryer.

FIG. 7 is a perspective view illustrating an outer appearance of a lint filter assembly mounted on the lint filter cleaning device according to an embodiment, and FIG. 8 is a longitudinal cross-sectional view taken along line VIII-VIII of FIG. 7.

Referring to FIGS. 7 and 8, the lint filter assembly according to an embodiment may include a bracket 321 seated on a top surface of the filter housing 311, a filter frame 326 having an approximately rectangular shape that vertically extends downward from a bottom surface of the bracket 321, a partition rib 327 partitioning the inside of the filter frame 326 in a lattice shape, and a mesh member 325 coupled to an inner space part of the filter frame 326.

In detail, the partition rib 327 may be integrated with the filter frame 326 as one body. A plurality of vertical ribs 327*a* and horizontal ribs 327*b* may be disposed in directions perpendicular to each other. Thus, the mesh member 325 may be partitioned by a plurality of filtering blocks.

The plurality of filtering blocks may have the same size. On the other hand, the filtering blocks may be designed so that the filtering blocks have sizes that gradually decrease or increase toward a lower side of the lint filter assembly 32 by adjusting a distance between the vertical ribs 327*a* and a distance between the horizontal ribs 327*b*. For example, the filtering blocks may have heights or widths that gradually increase or decrease toward the lower side of the lint filter assembly 32.

Also, the mesh member 325 may be attached to a front surface of the filter frame 326. Here, the front surface of the filter frame 326 may be defined as a surface opposite to a surface that collides with the air flowing along the guide duct 15.

Also, a plurality of port mounting parts 322 is disposed on the bracket 321. The plurality of port mounting parts 322 may be provided in number corresponding to that of plurality supply ports 331 to 334. In the current embodiment, first to fourth port mounting parts may be provided.

Also, a water guide 323 extends from a bottom surface of the bracket 321, which corresponds to a lower side of each of the port mounting parts 322. An inlet of the water guide 323 may communicate with the port mounting part 322, and an outlet of the water guide 323 may communicate with the one or plurality of filtering blocks in a transverse direction.

Also, a discharge hole 324 is defined in an outlet end of the water guide 323 so that the cleaning water flows downward. The discharge hole 324 may be a slit defined in a bottom part of the water guide 323 in a transverse direction. Also, the slit may have a length corresponding to a width of each of one or plurality of filtering blocks in the transverse direction.

For example, in case of a structure in which one water guide 323 covers a single filtering block, the port mounting part 322 having numbers corresponding to that of filtering blocks disposed in transverse direction may be disposed inside the lint filer assembly 32. Also, the discharge hole 324 may have a width corresponding to that of one filtering block.

Alternatively, in case of a structure in which one water guide 323 covers two filtering blocks, the port mounting part 322 having numbers corresponding to a half of the number of filtering blocks in the transverse direction may be provided. Here, the width of the discharge hole 324 may doubly increase.

According to the above-described structure, the cleaning water guided by the water guide 323 may flow down from the uppermost filtering block to the lowermost filtering block along the mesh member 325. Here, the lint lump collected onto each of the filtering blocks may flow down together with the cleaning water. Also, the separated lint lump and cleaning water may be collected into the pump housing 312 through the communication hole 315 along the inclined bottom surface of the filter housing 311.

A flow groove 328 may be defined between the mesh member 325 and the horizontal rib 327*b* so that the cleaning water smoothly flows down along the mesh member 325. The flow groove 328 may be a long grove that is recessed by a predetermined depth from a front surface of the horizontal rib 327*b* contacting the mesh member 325. The flow groove 328 may be defined by the horizontal rib 327*b* that defines each of the filtering blocks.

Here, when the cleaning water is supplied into the plurality of supply ports 331, 332, 333, and 334 at the same time, lint attached to the filtering block of the lint filter assembly 32 may be separated once to drop down onto the bottom of the filter housing 311. As a result, a large amount of lint lumps may be introduced into the drain pump 36 at the same time to block the drain pump 36. Thus, the drain pump 36 may become to an abnormal state. To solve the above-described limitation, it may be necessary to separate a small amount of lint lumps from the filtering blocks with a time difference and to allow the separated lint lumps to flow into the drain pump 36.

For this, the supply ports 331, 332, 333, and 334 constituting the water supply port array 33 may be alternately opened with a time difference. For example, the control valve 35 may operate to successively open supply ports 331 to 334 from the first supply port 331 that is the closet to the drain pump to the fourth supply port 334 that is the farthest to the drain pump to prevent the lint lumps from being introduced into the drain pump 36 at once.

Alternatively, the control valve 35 may operate so that odd-numbered supply ports 331 and 333 are opened first, and then even-numbered supply ports 332 and 334 are opened after a preset time elapses.

Also, the lint filter cleaning process may be partitively performed several times during the cleaning process to prevent a large amount of lint lumps from being introduced into the drain pump at once.

As described above, in the lint filter cleaning device 30 according to an embodiment, the mesh member 325 of the lint filter assembly 32 may be partitioned into the plurality of filtering blocks to form a plurality of lint lumps each of which has a small size.

Furthermore, the opening degree may be variously controlled by the control valve 35.

Thus, the lint lumps attached to the lint filter assembly 32 may not be separated at once, but be successively separated with a time difference. As a result, the blocking of the inlet of the drain pump 35 may be prevented.

FIG. 9 is a perspective view illustrating an outer appearance of a lint filter assembly according to another embodiment.

Referring to FIG. 9, a lint filter assembly 32 according to the current embodiment has the same structure as the lint filter assembly 32 of FIG. 8 except for only a structure of a flow groove 328.

In detail, in case of the lint filter assembly 32 according to the foregoing embodiment, one long groove is defined in each of the filtering blocks. However, according to the current embodiment, a plurality of short grooves are defined to be spaced a predetermined distance from each other.

Since the lint filter assembly 32 has the same structure as that according to the foregoing embodiment except for the groove, duplicated descriptions will be omitted.

FIG. 10 is a perspective view illustrating an outer appearance of a lint filter assembly according to further another embodiment, and FIG. 11 is a longitudinal cross-sectional view taken along line XI-XI of FIG. 10.

Referring to FIGS. 11 and 12, a lint filter assembly 42 according to the current embodiment includes a bracket 421, a water guide 423, a discharge hole 424, a mesh member 325, and a partition rib constituted by a vertical rib 427*a* and a horizontal rib 427*b*. The above-described components are the same as those according to the foregoing embodiment.

However, unlike the foregoing embodiment, the filter frame 426 is different in that the filter frame 426 is stepped in a stair shape. That is, the current embodiment may be different from the foregoing embodiment in that a stepped part 428 having the stair shape is disposed on each of both ends of the horizontal rib 427*b*, and cleaning water flowing from the water guide 423 flows in stages along the mesh member 425 and the horizontal rib 427*b*.

In detail, since the filter frame 426 is stepped in the stair shape, the mesh member 425 may be attached in the stair shape along a front surface of the filter frame 426.

That is, the mesh member 425 defining an upper filtering block may be disposed on a front surface of the horizontal frame 427*b* disposed between two filtering blocks adjacent to each other, and the horizontal frame 427*b* may have a structure having the same plane as the mesh member 425 defining a lower filtering block.

Thus, the cleaning water flowing trough the discharge hole 424 may flow along the mesh member 425 defining the upper filtering block and then flow along the top surface of the horizontal rib 427*b* to flow along the mesh member 425 defining the lower filter block.

As a result, the cleaning water successively flows from the uppermost filtering block to the lowermost filtering block to separate the lint lump attached to the uppermost filtering block and then separate the lint limp attached to the filter block disposed under the uppermost filtering block.

As described above, since the filter frame 326 is stepped in the stair shape, even though a separate flow groove is not defined in the front surface of the horizontal rib 427*b*, the cleaning water may smoothly flow down along the filtering assembly 42 to successively separate the lint lumps.

The invention claimed is:

1. A dryer for clothes, comprising:

a cabinet;

a drying drum accommodated in the cabinet and into which an object to be dried is put;

a suction passage supplying hot air into the drying drum;

a heating unit disposed in any position of the suction passage to heat air introduced into the suction passage at a high temperature;

an exhaust passage through the hot air discharged from the drying drum flows;

a blower mounted on one position of the exhaust passage to forcibly blow the hot air within the drying drum;

a lint filter assembly mounted on the other position of the exhaust passage; and a lint filter cleaning device for removing lint attached to the lint filter assembly, wherein the lint filter assembly comprises:

a filter frame defining an edge thereof;

a mesh member attached to the filter frame to cover an inner region of the filter frame; and a partition rib comprising a plurality of horizontal ribs and vertical ribs which are disposed inside the filter frame, wherein the mesh member is partitioned into a plurality of filtering blocks by the plurality of horizontal ribs and vertical ribs.

2. The dryer according to claim 1, wherein a flow groove for allowing cleaning water to smoothly flow is defined in a front surface of each of the horizontal ribs contacting the mesh member.

3. The dryer according to claim 2, wherein the flow groove is defined in each of the filtering blocks, and is formed in a single or in plurality in each of the filtering blocks.

4. The dryer according to claim 1, wherein the filter frame is stepped downward in a stair shape, and the filtering blocks adjacent to each other in a vertical direction are disposed on vertical surfaces different from each other.

5. The dryer according to claim 4, wherein each of the plurality of horizontal ribs has both ends connected to a stepped portion of the filter frame.

6. The dryer according to claim 1, wherein the filter blocks have a same size or sizes that are different from each other toward a lower end of the lint filter assembly.

7. The dryer according to claim 1, wherein the lint filter assembly further comprises a bracket connected to an upper end of the filter frame, a plurality of water supply tubes for supplying cleaning water are connected to a top surface of the bracket, and a water guide for guiding the cleaning water supplied from the plurality of water supply tubes toward the mesh member is disposed on a bottom surface of the bracket.

8. The dryer according to claim 7, wherein the lint filter cleaning device comprises:

a control valve comprising an inflow port through which the supplied cleaning water is introduced and a plurality of supply ports respectively connected to inlets of the plurality of water supply tubes, the control valve selectively opening the plurality of water supply tubes; and a drain pump discharging the cleaning water flowing down along the mesh member and lint lumps separated from the mesh member to the outside.

9. The dryer according to claim 8, wherein the lint filter cleaning device further comprises a case, the case including a pump housing accommodating the drain pump and a filter housing accommodating the lint filter assembly, wherein the pump housing and the filter housing define spaces independent from each other and are fluidly connected to each other by a communication hole defined in a wall that partitions the pump housing from the filter housing.

10. The dryer according to claim 8, wherein a bottom part of the filter housing and a lower end of the lint filter assembly are inclined upward in a direction that is away from the communication hole.

11. The dryer according to claim 8, further comprising:

an inflow hole through which the hot air passing through the drying drum is introduced defined in a first surface of the filter housing, the first surface configured to face a front surface of the lint filter assembly; and a discharge hole through which the hot air passing through the lint filter assembly is discharged defined in a second surface of the filter housing, the second surface configured to face a rear surface of the lint filter assembly.

12. The dryer according to claim 11, wherein the plurality of water supply tubes are disposed in a line in a width direction of the lint filter assembly on the bracket, and the width direction of the lint filter assembly is a direction that is away from the communication hole.

13. The dryer according to claim 12, wherein the control valve is configured to successively or selectively open the plurality of water supply tubes with a time difference so that the lint lumps respectively disposed on the plurality of filtering blocks are separated for each area with a time difference.

14. The dryer according to claim 13, wherein one group of an odd-numbered water supply tube group and an even-numbered water supply tube group of the plurality of water supply tubes is opened first, and then an other group is opened with a time difference.

15. The dryer according to claim 13, wherein the water supply tubes of one group of an odd-numbered water supply tube group and an even-numbered water supply tube group of the plurality of water supply tubes are successively opened with a time difference, and then the water supply tubes of an other group are successively opened with a time difference.

16. The dryer according to claim 13, wherein the water supply tubes, which is closet to the drain pump, of the plurality of water supply tubes is opened first, and then the water supply tubes which are away from the drain pump are successively opened with a time difference.

* * * * *